US008123548B2

(12) United States Patent
Grankvist et al.

(10) Patent No.: US 8,123,548 B2
(45) Date of Patent: Feb. 28, 2012

(54) ARRANGEMENT FOR ELECTRICAL EARTHING OF AN INSULATED CABLE

(75) Inventors: Stefan Grankvist, Skellefteå (SE); Lars Hedström, Skellefteå (SE); Robert Lindberg, Skellefteå (SE); Kjell Nyström, Skellefteå (SE)

(73) Assignee: MT Skellefteå Memoteknik AB, Skellefteå (SE)

( * ) Notice: Subject to any disclaimer, the term of this patent is extended or adjusted under 35 U.S.C. 154(b) by 189 days.

(21) Appl. No.: 12/311,119

(22) PCT Filed: Aug. 30, 2007

(86) PCT No.: PCT/SE2007/050594

§ 371 (c)(1), (2), (4) Date: Jul. 16, 2009

(87) PCT Pub. No.: WO2008/036032

PCT Pub. Date: Mar. 27, 2008

(65) Prior Publication Data

US 2009/0286420 A1 Nov. 19, 2009

(30) Foreign Application Priority Data

Sep. 22, 2006 (SE) ..... 0602000

(51) Int. Cl.
*H01R 11/20* (2006.01)

(52) U.S. Cl. ..... 439/394

(58) Field of Classification Search ..... 439/394–395, 439/443, 98

See application file for complete search history.

(56) References Cited

U.S. PATENT DOCUMENTS 4,708,414 A 11/1987 Lam
5,041,013 A 8/1991 Greenbaum
5,713,748 A 2/1998 Mulvihill
5,850,056 A 12/1998 Harwath
6,065,998 A * 5/2000 Peloza ..... 439/578

OTHER PUBLICATIONS

International Search Report for PCT/SE2007/050594, mailed Dec. 20, 2007.
Written Opinion of the International Searching Authority for PCT/SE2007/050594, mailed Dec. 20, 2007.
International Preliminary Report on Patentability for PCT/SE2007/050594, mailed Apr. 4, 2008.

* cited by examiner

*Primary Examiner* — Vanessa Girardi
(74) *Attorney, Agent, or Firm* — Nixon & Vanderhye P.C.

(57) ABSTRACT

An arrangement (1) for the electrical earthing of an electrically conducting cable (2) with an outer insulating protective cover (3). The arrangement comprises a receiver (4) and a drop unit (5). The receiver (4) comprises a bottom element (6), two opposing side elements (7*a*, 7*b*), two opposing open sides (8*a*, 8*b*). The bottom element (6) and the side elements (7*a*, 7*b*) form together a cleft (9), which cleft (9) is the receiver of the said cable (2) for earthing. The drop unit (5) comprises not only a connection to earth (10), but also a penetration means (11), which connection to earth (10) and penetration means (11) are in electrical contact with each other. The drop unit (5) is connected to the receiver (4) in such a manner that the drop unit (5) is placed during earthing of the said cable (2) opposite to the bottom element (6) of the receiver (4), whereby the cable (2) when seen in cross section through a straight cable (2) and arrangement (1) transverse to the longitudinal direction of the cable (2) is surrounded by the arrangement (1), and the penetration means (11) has penetrated through the said outer insulating protective cover (3) on the cable (2), whereby contact with a conductor inside the cable (2) is obtained.

7 Claims, 3 Drawing Sheets

ARRANGEMENT FOR ELECTRICAL EARTHING OF AN INSULATED CABLE

This application is the U.S. national phase of International Application No. PCT/SE2007/050594, filed 30 Aug. 2007, which designated the U.S. and claims priority to Sweden Application No. 0602000-2, filed 22 Sep. 2006, the entire contents of each of which are hereby incorporated by reference.

TECHNICAL AREA

The present invention concerns an arrangement for the electrical earthing of an insulated electrically conducting cable with an external protective cover as specified by the introduction to claim 1. Such cables can be constituted by, for example, coaxial cables that connect an aerial to a radio base-station, where it is an advantage that such a cable needs to be earthed.

BACKGROUND OF THE INVENTION

The American patent document U.S. Pat. No. 5,850,056 reveals an arrangement intended to earth an insulated cable. The disadvantage of the invention according to the said patent document is that the cable that is to be earthed must be prepared. This takes place through the cable that is to be earthed according to the said American patent document having a portion of its outer protective cover removed. This is done since the cover covers that area of the cable to which an earth is to be connected. This is an operation that requires a number of tools, while at the same time being time-consuming.

SUMMARY OF THE INVENTION

One aim of the present invention is to achieve an arrangement that makes possible the earthing of an insulated cable where the problems describe above are eliminated.

A further aim of the present invention is to create an arrangement that make possible the earthing of an insulated cable and which arrangement is simple to construct, while the arrangement entails the saving of time and reduction in costs for a user.

The aims described above, and other aims, are achieved according to the invention through the arrangement that has been described in the introduction having been given the characteristics that are revealed by claim 1.

One advantage that is achieved with an arrangement according to the characterising part of claim 1 is that when earthing an insulated cable, the cable to which the arrangement is applied does not need to be prepared for treatment. The term "prepared for treatment" is used to denote the process in which an insulated cable is stripped of its protective cover before earthing. This traditionally takes place through the removal of a part of the insulating outer protective cover, whereby a conductor within the cable is revealed. After the revealing of a conductor in the traditional manner, it is subsequently possible to apply an earth connector to the revealed conductor, whereby the cable can be earthed.

Preferred embodiments of the arrangement according to the invention have furthermore been given the characteristics that are revealed by the non-independent claims 2-9.

According to one embodiment of the invention, each side element comprises a surface that is located opposite to the second side element, which surface comprises a track that extended from the open end of the receiver, parallel with the bottom element, to a hole that is located in and passes through the said surface, which hole has a diameter that is greater than the width across the track in the surface. The track in the surface has an opening that may be milled, pressed, punched or created in another manner that is known to one skilled in the arts as a method of providing a surface with a track. It is an advantage if the hole has been drilled into the surface and through the side element. The track extends, as has been mentioned, from one end of the side element to the said hole.

According to a further embodiment of the invention, the drop unit comprises not only an upper part but also a lower part, which upper part comprises a connection to earth and two shoulders, which shoulders are parallel to each other and are located at two sides of the drop unit that are opposite to each other and facing away from each other, which shoulders form a boundary with the lower part, which lower part comprises two pins that are located on two surfaces that are directed away from and opposite to each other, which surfaces are parallel with the respective shoulder, which pins are directed away from the relevant surface on which they are located, which pins and lower part of the arrangement are passed through by a putative axle around which axle the drop unit may be rotated. The drop unit has an upper part that has an upper region, which upper region is arched around an extended ridge. This ridge has a direction away from the arrangement. The arched form transitions into the said shoulders on each side of the ridge. The shoulders are, as has been previously mentioned, parallel to each other. They are also parallel to the said ridge. The shoulders have a length that is shorter than that of the said ridge. The lower part is located under the shoulders. Each shoulder has a lower side that is turned in a direction opposite to that of the direction of the ridge. This lower side forms a right angle with the lower part of the drop unit. This right angle to the lower part is formed to a plane in a surface of the lower part, which plane is parallel with a corresponding surface on the opposite side of the lower part. The distance between these corresponding surfaces constitutes the width of the lower part, whereby the lower part has such a width that it fits between the said side elements. The lower part has a length that corresponds to the extent of the said ridge. Each surface of the lower part has a length that corresponds to the length of the ridge. The edge sections of the upper part are thus shorter than the length of the said surface of the lower part. A part of the said surface is in this way obtained that borders in one direction, parallel to the direction of the ridge in its direction out from and away from arrangement, the arching of the upper part, and thus does not border any shoulder. The said pins are located in this region.

According to a further embodiment of the invention, the drop unit and the receiver are connected to each other in such a manner that not only are they prevented from rotating relative to each other when in a first position relative to each other, but also allowed to rotate relative to each other when in a second position relative to each other. The lower part of the drop unit is arranged when in the first position to fit in between the side elements of the receiver, whereby the relevant pin is arranged to fit into the relevant track on the receiver, whereby the relevant pin has a design such that the pins and the drop unit relative to the receiver, when the pins are located in the said tracks, are prevented from rotating relative to each other, whereby the drop unit and the receiver are thus positioned in an open condition. In the second position, the drop unit is connected with the receiver in a manner that allows rotation through the relevant pin being located in the relevant hole in the relevant side element, whereby rotation between the drop unit and the receiver takes place around the said axle, which axle extends transversely across a straight cable that is placed between the receiver and the drop unit, whereby the drop unit and the receiver rotate relative to each other until they are positioned in a closed condition.

According to a further embodiment of the invention, the drop unit and the receiver are positioned in a closed condition when the shoulders of the drop unit are in contact with the side elements of the receiver, whereby the shoulders prevent in this manner further rotation of the drop unit once the bottom section and the lower part are parallel to each other. It is in this way prevented that the cable, which is placed between the receiver and the drop unit, is destroyed by crushing due to the drop unit, for example, being subject to a pressure that is too high.

According to a further embodiment of the invention, the penetration means is fixed attached to the drop unit, whereby the penetration means penetrates into and through the insulation of the said cable that is located in the receiver on rotation between the drop unit and the receiver around the said axle and on reduction of the angle between the drop unit and the receiver. The drop unit acts as a lever for the arrangement when the drop unit is brought into contact with the cable placed between the drop unit and the receiver. The drop unit rotates until the shoulders stop the rotation through contact with the side sections. The ridge of the drop unit is parallel with the shoulders in this position. In the continued process, the ridge of the drop unit is parallel with the lower side of the drop unit, which lower side is parallel with the bottom element in this closed condition. The penetration means has in this position entered into and through the insulating protective cover of the said cable. The penetration means enters sufficiently deeply into and through the said protective cover whereby contact with a conductor in the cable is obtained, whereby the said conductor is earthed.

According to a further embodiment of the invention, the penetration means comprises a first and a second knife, which knives are located on the lower part of the drop unit, whereby each knife has such a location on the lower part that the knife on rotation between the drop unit and the receiver passes in direct vicinity to and parallel to the respective opposite surface of the respective opposite side element. Furthermore, each knife comprises an edge that when the arrangement is located in its closed condition not only has a direction towards the bottom element, but is also partially angled towards the edge of the second knife. The principal part of the respective edge is parallel to the ridge of the drop unit. The edge of each knife descends towards the surface of the cable in a manner corresponding to that of scissors cutting through, for example, paper. The edge penetrates the outer cover of the cable with an angle between the edge and the insulating outer cover. The angle between the edge and the outer cover ensures that less force is required to penetrate through the said insulating protective cover than is required when the edge is pressed when perpendicular to the outer cover, such as occurs in, for example, a punch. One advantage of this is, as has been mentioned, that less force is thus required to penetrate through the outer cover than is required if the edge were to be applied perpendicular to the cable in the longitudinal direction of the cable. Through the respective edges being placed partially at an angle to each other, it is also ensured that the knife penetrates sufficiently in to a conductor for earthing within the insulating outer cover in the conducting cable. This is the case as the angle ensures that the knife in question cuts into the cable towards the conductors that are located within it.

BRIEF DESCRIPTION OF THE DRAWINGS

One preferred embodiment of the arrangement according to the invention will now be described in more detail with reference to the attached drawings, which show only those items that are necessary for an understanding of the invention.

DETAILED DESCRIPTION OF DIFFERENT EMBODIMENTS OF THE INVENTION

Figure 1:
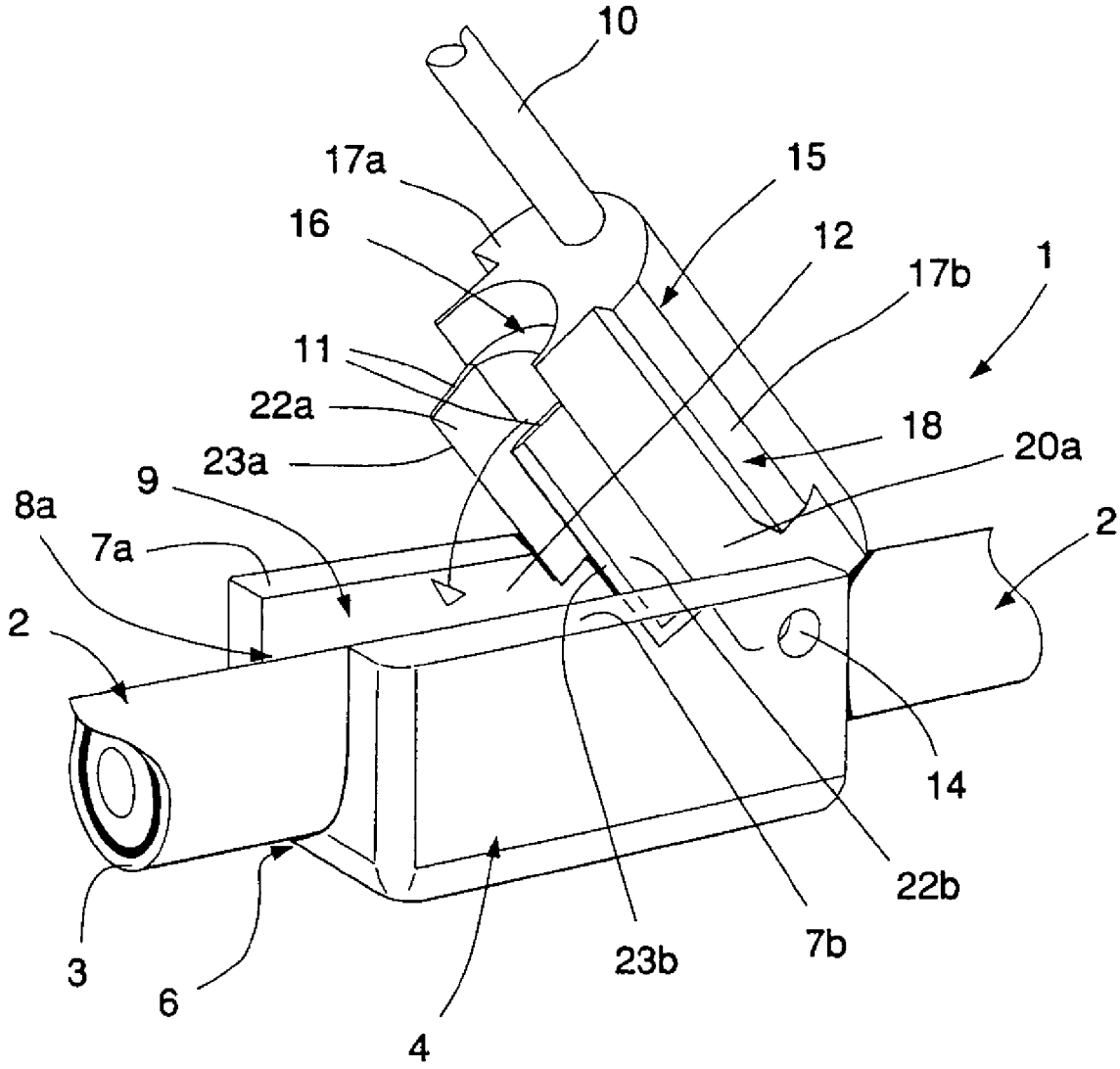
FIG. 1 shows an arrangement placed around a cable, which arrangement is located in an open condition.

FIG. 1 shows an arrangement (1) in an open condition that has been placed around a cable (2) comprising an insulating protective cover (3). The arrangement (1) comprises a receiver (4) and a drop unit (5) that are connected to each other in a manner that allows them to be disconnected.

The receiver (4) comprises a bottom element (6) and two side elements (7*a*, 7*b*), which side elements (7*a*, 7*b*) are located parallel to each other. The bottom element (6) and the side elements (7*a*, 7*b*) form together a cleft (9) that has an extended form. The receiver (4) has two open sides or ends (8*a*, 8*b*) in addition to the side elements (7*a*, 7*b*). A cable (2) that is located in the receiver (4) is thus located in the cleft (9) and extends through the open sides (8*a*, 8*b*). The cable (2) is parallel to the side elements (7*a*, 7*b*).

The drop unit (5) comprises a connection to earth (10), a penetration means (11), an upper part (15) and a lower part (16). The connection to earth (10) is located in the upper part (15). The upper part (15) comprises an upper surface that has a direction away from the drop unit (5). This surface has the form of an extended ridge, and it is arched in such a manner that the central section of the ridge is that part that is directed away from the drop unit (5). The form of the arch is symmetrical on each side of the said ridge and it transitions on each side (18) of the drop unit (5) into a shoulder (17*a*, 17*b*). The shoulders (17*a*, 17*b*) are parallel to the extent of the ridge. The lower part (16) of the drop unit (5) comprises the said penetration means (11). The penetration means (11) has a direction that is opposite to the direction of the said ridge. The lower part (16) comprises one surface (20*a*, 20*b*) on each side (18) of the drop unit. The shoulders (17*a*, 17*b*) border the said surfaces (20*a*, 20*b*) on the lower part (16). These surfaces (20*a*, 20*b*) are parallel to each other and they constitute the width of the lower part (16). This width is such that the lower part (16) fits between the side elements (7*a*, 7*b*) of the receiver (4). The penetration means (11) is placed in connection with these surfaces (20*a*, 20*b*) in such a manner that the said surfaces (20*a*, 20*b*) border the penetration means (11).

The penetration means (11) according to one preferred embodiment is constituted by two knives (22*a*, 22*b*). These knives (22*a*, 22*b*) are extended and are located in the immediate vicinity of the relevant said surface (20*a*, 20*b*) whereby the knives (22*a*, 22*b*) are located more closely to each other than to the said surfaces (20*a*, 20*b*) of the lower part (16). Each knife (22*a*, 22*b*) comprises an edge (23*a*, 23*b*) that has an extension that is principally parallel with the relevant shoulder (17*a*, 17*b*) and ridge.

Figure 2:
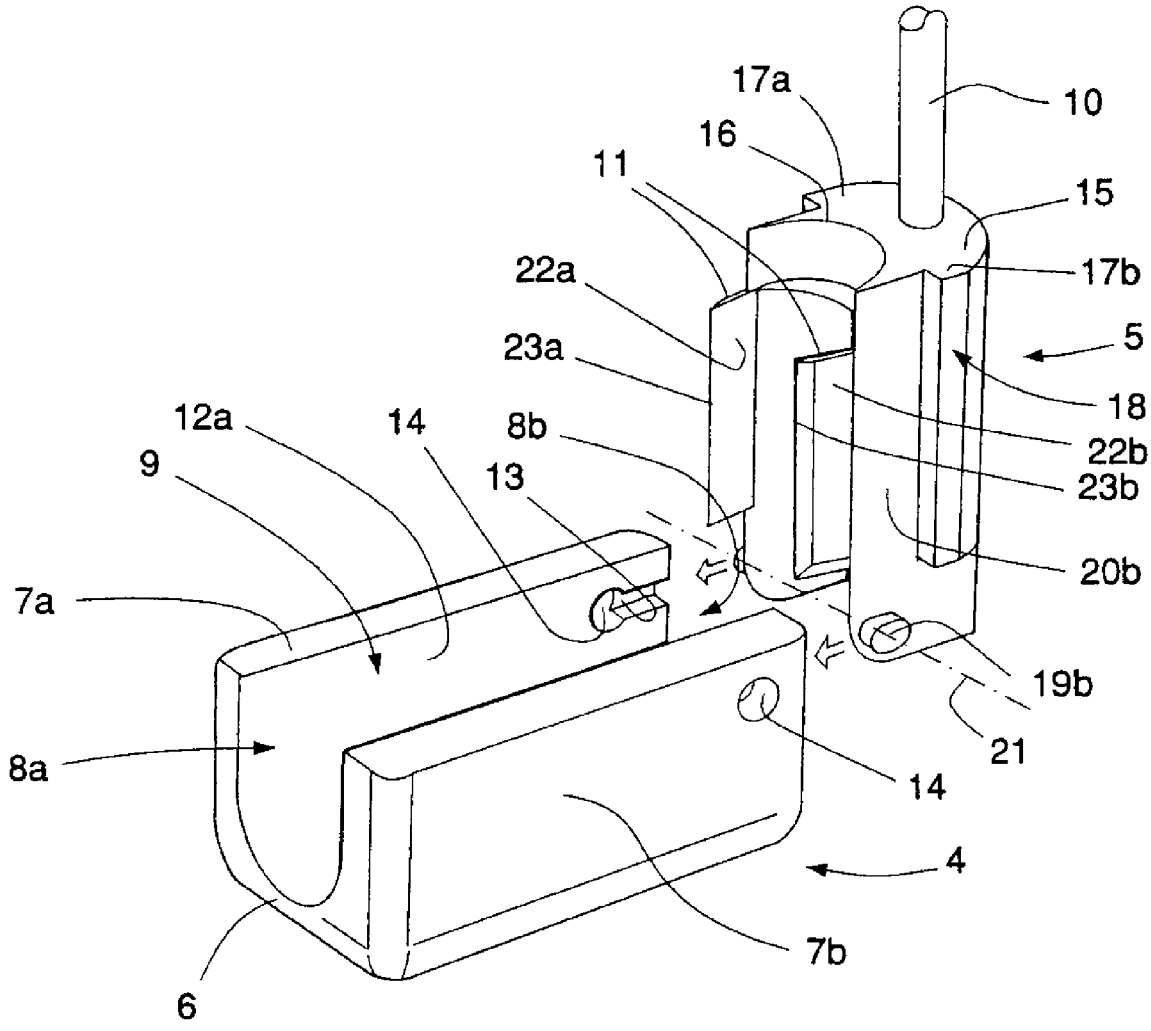
FIG. 2 shows a receiver and a drop unit before they have been united.

FIG. 2 shows the arrangement (1) before the receiver (4) and the drop unit (5) have been combined into one unit. It can be seen in FIG. 2 that the receiver (4) comprises two surfaces (12*a*, 12*b*) opposing each other on opposing side elements (7*a*, 7*b*). Each surface (12*a*, 12*b*) comprises a track (13). This track (13) extends from the open end (8*b*) and runs parallel to the bottom element (6) to a hole (14) in and through the said surface (12*a*, 12*b*). The diameter of this hole (14) is greater than the width of the track (13) in the surface (12*a*, 12*b*). The drop unit (5) in FIG. 2 comprises two pins (19*a*, 19*b*) located one on each side (18) of the drop unit (5). The pins (19*a*, 19*b*) are directed out from the surfaces (20*a*, 20*b*) that belong to the lower part of the drop unit (5). The pins (19*a*, 19*b*) have such a form that they prevent rotation between the receiver (4) and the drop unit (5) when they are introduced into the relevant track (13) in the receiver (4). As introduction of the drop unit (5) continues, each pin (19*a*, 19*b*) will arrive at the end of the track (13) along its longitudinal extent. The track (13) transitions into the said hole (14) at this end. The hole (14) has a diameter that is greater than the greatest width of the pin (19*a*, 19*b*) when this is measured along the direction in which the relevant pin (19*a*, 19*b*) is introduced into the track (13). The drop unit (5) can thus rotate relative to the receiver, when the pins (19*a*, 19*b*) are located in the said holes (14), relative to the receiver, around a putative axle (21) that not only extends through the pins (19*a*, 19*b*) but also extends through the holes (14) in each opposing side element.

Figure 3:
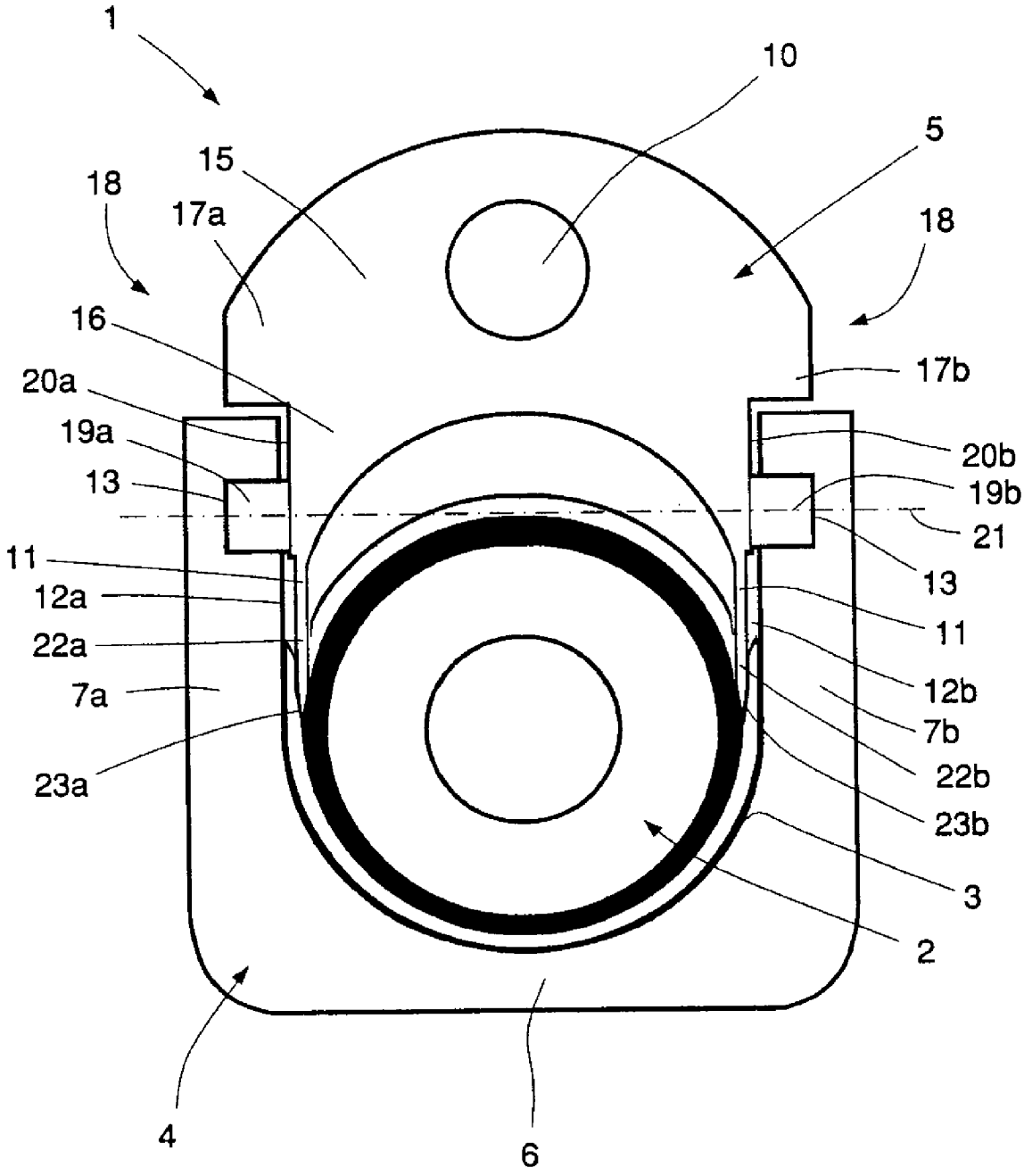
FIG. 3 shows an arrangement in a closed condition that surrounds an earthed cable, in cross section through the arrangement and the cable, in a section transverse to a straight cable through the arrangement.

FIG. 3 shows in cross section the arrangement (1) in a closed condition. In this condition, a cable (2) has been placed into the receiver (4) and the drop unit (5) has been rotated around the said axle (21) by force. The drop unit (5) is prevented from continued rotation when the shoulders (17*a*, 17*b*) make contact with the side elements (7*a*, 7*b*) or if the pressure from the cable (2) within the arrangement becomes too high. It can be seen in FIG. 3 how each knife (22*a*, 22*b*) has penetrated the insulating protective cover (3) into the cable (2). Each knife (22*a*, 22*b*) makes contact with one conductor inside the cable (2) after the penetration operation through the said insulating protective cover (3). Each knife (22*a*, 22*b*), which may, naturally, be constituted by a similar element with a penetrating function, that constitutes the penetration means (11) is connected with the said connection to earth (10) in the upper part (15) of the drop unit (5). Given that contact is made between knife (22*a*, 22*b*) and conductors within the said insulating protective cover (3) in the cable (2), earth contact can be obtained for the said cable (2) in such a manner that the cable (2) does not need to be pre-treated through, for example, stripping off the cover before the earth is applied to the cable (2).

In order to prevent the penetration of moisture or similar into the cut region after the knives (22*a*, 22*b*) have either cut or penetrated into, or both, the said insulating protective cover (3), it is an advantage if parts of the knives (22*a*, 22*b*) are supplied with liquid resin that is caused to flow out and seal the contact surfaces obtained (not shown in the drawings).

The invention is not limited to the embodiments displayed: it can be varied and modified within the framework of the attached patent claims, as has been partially described above.

The invention claimed is:

1. An arrangement for electrical earthing an outer conductor or shield of a coaxial cable, the arrangement comprising a receiver and a drop unit wherein the drop unit is connected to the receiver to be articulated about an axis, the drop unit by rotation is adapted to be brought to a folded position with the receiver, wherein the receiver comprises a cleft that is defined by a bottom element, two opposing side elements, and two opposing open sides and adapted to receive the cable, the drop unit comprising a connection to earth and a penetration device that is in electrical connection with said earth connection and adapted to penetrate through an outer insulating protective cover of the cable to contact the outer conductor of the cable, when the arrangement is brought in its folded position, wherein the drop unit comprises an upper part to which the connection to earth is attached and a lower part arranged to fit between the side elements of the receiver and in a position surrounding the coaxial cable in conjunction with said side elements and the bottom element of the receiver, the drop unit and the receiver are detachably connectable to each other by cooperating tracks and pins arranged in the drop unit and the receiver and that the both parts can be connected together for mutual rotation via the axis, wherein the axis extends through each of the both opposing side elements, and is located such that the coaxial cable, extending through each of the open sides, can be located arbitrarily along its length in the cleft before the drop unit and the receiver are clamped together, whereby the penetration device is designed to be in tangentially contact with the outer conductor or shield of the cable in the clamped position.

2. The arrangement according to claim 1, wherein the drop unit comprises shoulders which, in conjunction with an upper surface of the side elements of the receiver, limits rotation of the drop unit around the axis on the receiver.

3. The arrangement according to claim 1, wherein the penetration device comprises a first and a second knife, located on the lower part of the drop unit, whereby each knife has such a location on the lower part that after a completed penetrating the coaxial cable outer insulating protective cover, each knife is in tangentially contact with outer conductor of the coaxial cable when located in the receiver.

4. The arrangement according to claim 1, wherein the axle for the articulated joint connection between the drop unit and the receiver extends across the cable when located in the receiver.

5. The arrangement according to claim 4, wherein the axis is located above the coaxial cable with respect to the bottom element.

6. The arrangement according to claim 1, wherein the tracks are arranged on opposing sides of the side elements of the receiver and which tracks extends from an open end of the receiver while the pins being located on two sides of the drop unit and directed away from each other and slidable into the tracks.

7. The arrangement according to claim 6, wherein the each of the tracks that extends from the open end of the receiver, runs parallel to the bottom element to reach a circular hole that is located in and passes through the side surface, and which hole has a diameter that is greater than the width of the track in the surface; whereby each pin has such a design that the pins and the drop unit are, relative to the receiver, when the pins are located in the said tracks, prevented from rotating relative to each other but linear slidable, whereby the drop unit and the receiver are in this manner located in the open condition.

* * * * *